US005154485A

United States Patent [19]

Fleishman

[11] Patent Number: 5,154,485

[45] Date of Patent: Oct. 13, 1992

[54] SPRING PLATE FURNITURE

[76] Inventor: Gregg R. Fleishman, 2742-32 S. La Cienega Blvd., Los Angeles, Calif. 90034

[21] Appl. No.: 522,329

[22] Filed: May 11, 1990

[51] Int. Cl.[5] ..... A47C 7/02

[52] U.S. Cl. ..... 297/445; 297/457; 267/142

[58] Field of Search ..... 297/445, 452, 457, DIG. 2, 297/16; 367/142

[56] References Cited

U.S. PATENT DOCUMENTS

| | | | |
|---|---|---|---|
| Re. 26,947 | 6/1970 | Getz et al. . | |
| 457,637 | 8/1891 | De Frehn et al. . | |
| 2,185,929 | 5/1939 | Dunajeff | 297/452 X |
| 2,530,924 | 11/1950 | Turner . | |
| 2,670,787 | 3/1954 | Vandas et al. | 297/457 X |
| 3,353,869 | 11/1967 | Getz et al. . | |
| 3,557,264 | 1/1971 | Getz et al. . | |
| 3,669,496 | 6/1972 | Chisolm | 297/445 |
| 4,366,980 | 1/1983 | Rowland | 297/445 X |
| 4,368,917 | 1/1983 | Urai | 297/452 |
| 4,390,204 | 6/1983 | Fleishman . | |
| 4,418,958 | 12/1983 | Watkin | 297/457 |
| 4,502,731 | 3/1985 | Snider | 297/452 |
| 4,533,174 | 8/1985 | Fleisman | 297/457 X |
| 4,602,819 | 7/1986 | Morel | 297/452 X |
| 4,660,887 | 4/1987 | Fleming et al. | 297/445 |
| 4,892,356 | 1/1990 | Pittman et al. | 297/457 |
| 4,962,964 | 10/1990 | Snodgrass | 297/DIG. 2 X |

FOREIGN PATENT DOCUMENTS

| | | | |
|---|---|---|---|
| 2260622 | 1/1974 | Fed. Rep. of Germany | 297/452 |

*Primary Examiner*—Jose V. Chen
*Attorney, Agent, or Firm*—William W. Haefliger

[57] ABSTRACT

Spring plate furniture wherein a planar spring is capable of resiliently supporting loads and/or resiliently being manipulated into a furniture form, the planar spring cut or molded so that usually continuous serpentine members extend between support points at which the cross-section or width of the serpentine members increases when the spring plate is to be subjected to loads and restrained from rotation.

17 Claims, 9 Drawing Sheets

FIG. 6a.
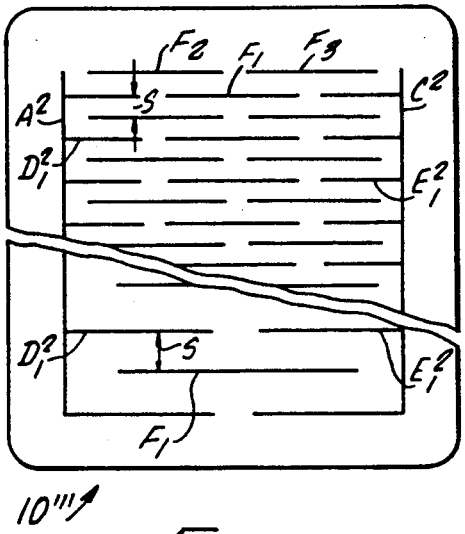
FIG. 6.
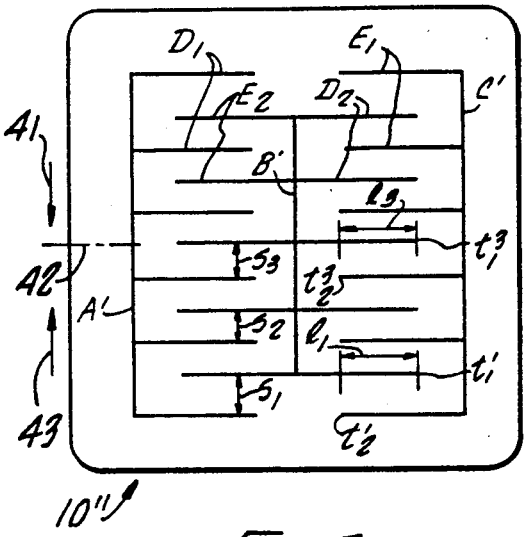
FIG. 7.
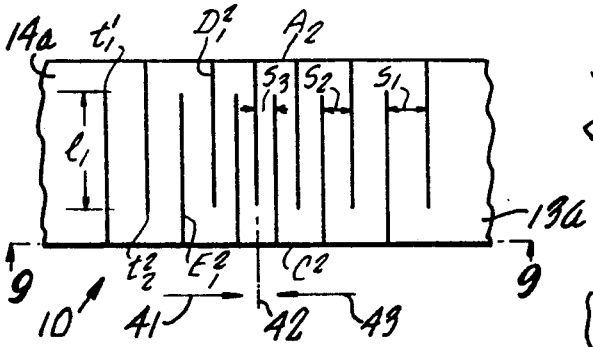
FIG. 8.
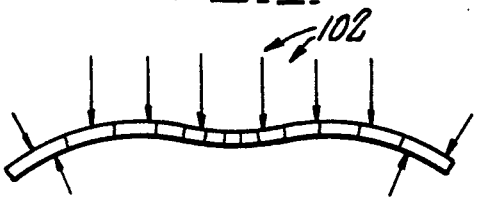
FIG. 11.
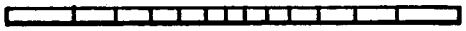
FIG. 9.
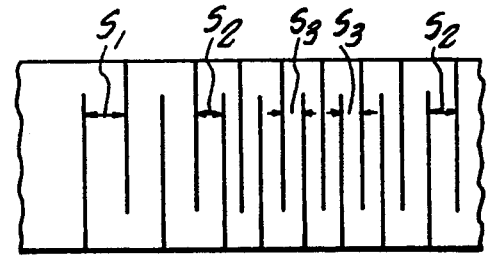
FIG. 12.
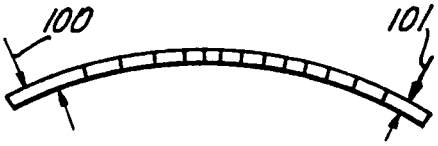
FIG. 10.
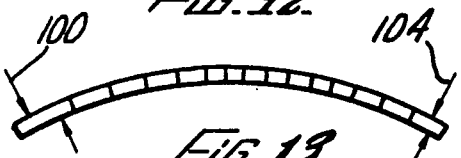
FIG. 13.
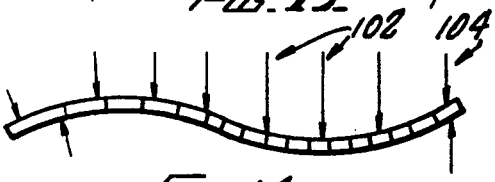
FIG. 14.

FIG. 15a.
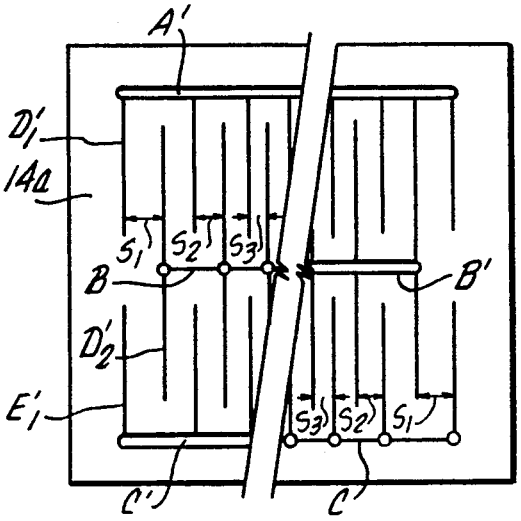
FIG. 15.
FIG. 16a.
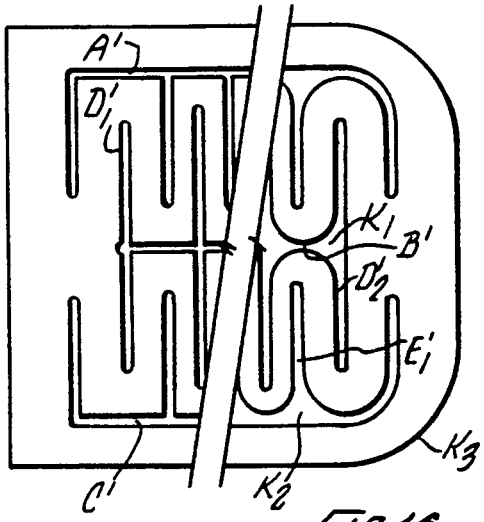
FIG. 16.
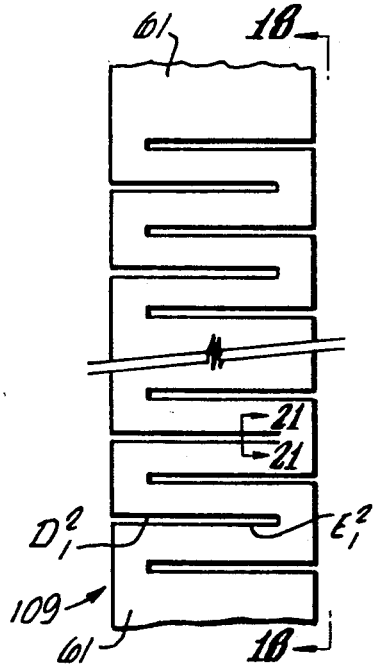
FIG. 17.
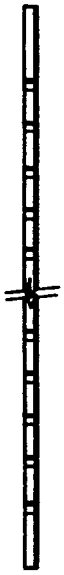
FIG. 18.
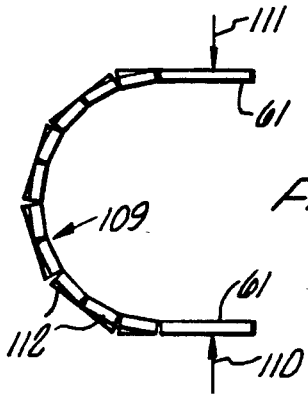
FIG. 19.
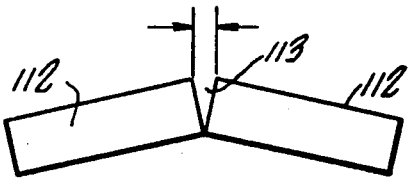
FIG. 20.
FIG. 21.
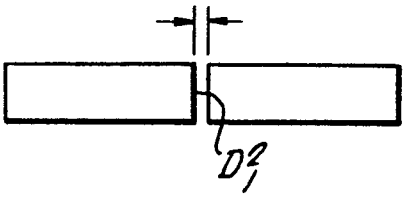

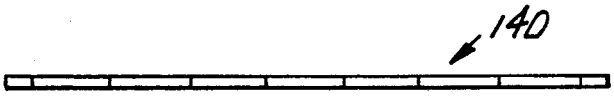
FIG. 31a
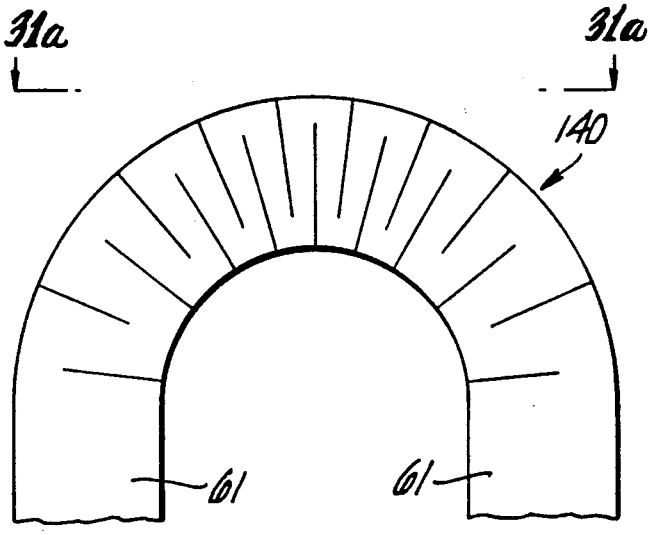
FIG. 31.
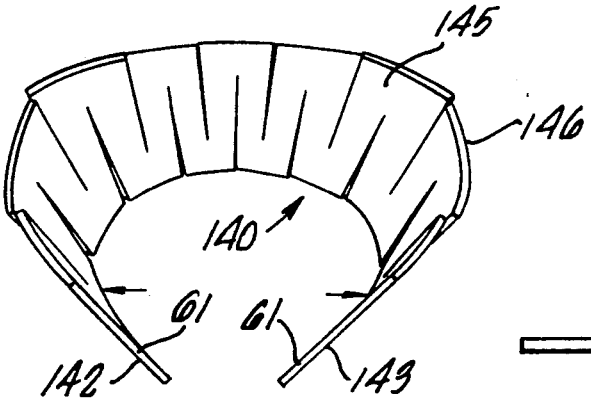
FIG. 32.
FIG. 33a.
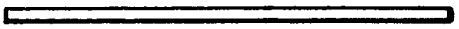
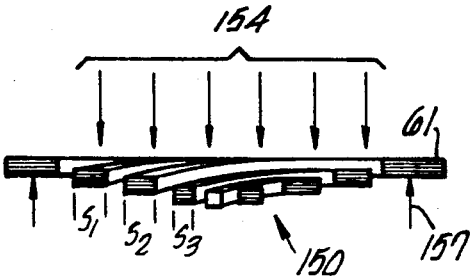
FIG. 34.
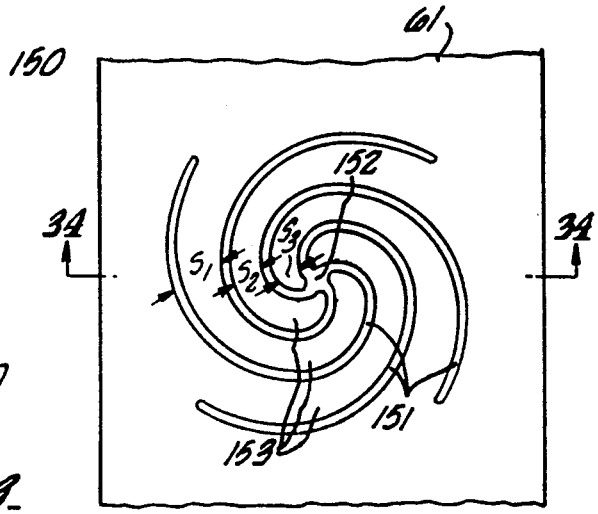
FIG. 33.

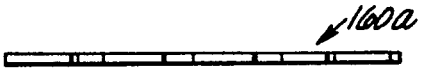
FIG. 35a
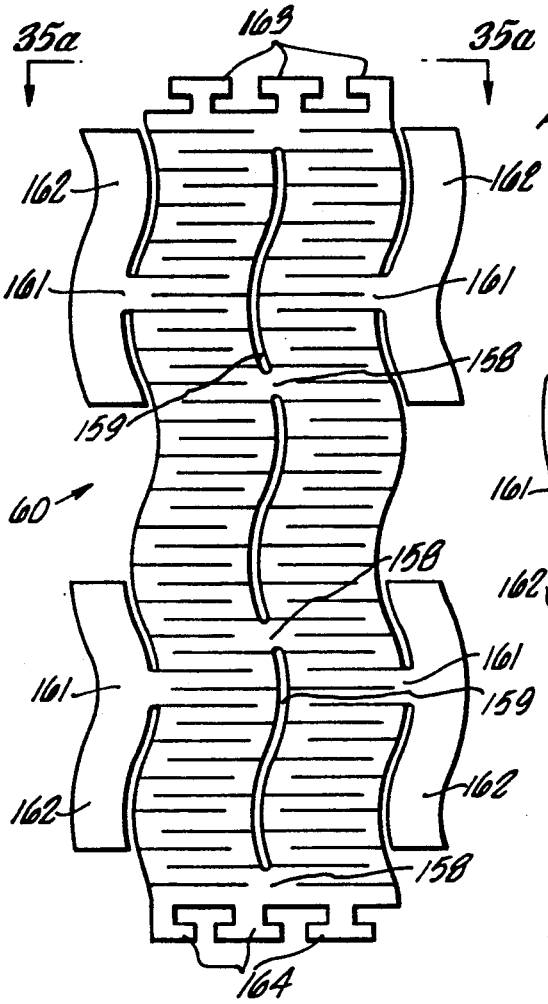
FIG. 35
FIG. 36
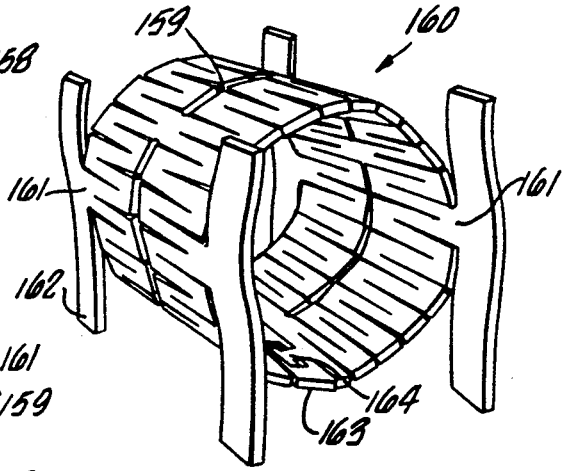
FIG. 38
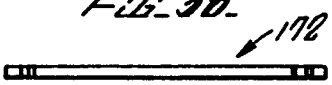
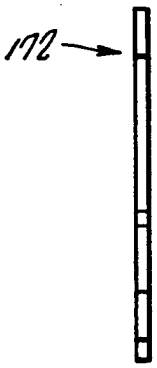
FIG. 39
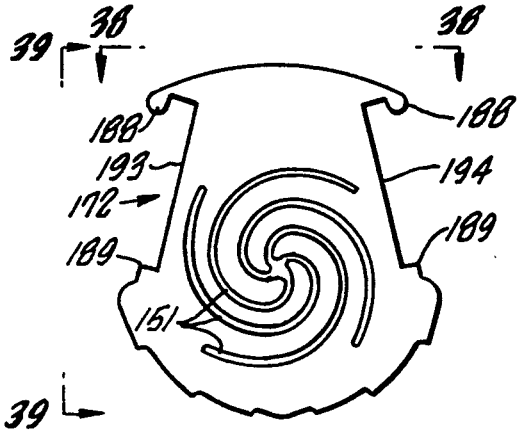
FIG. 37

SPRING PLATE FURNITURE

BACKGROUND OF THE INVENTION

This invention relates generally to planar or originally planar spring elements cut from or formed of generally homogeneous materials generally of uniform thickness, and more specifically to optimally designed planar spring elements properly engineered to minimize excess material and maximize useful lifespan.

Spring elements in the past have been commonly used to provide resilience, for instance coil springs, etc. used in cars, or in furniture, in mattresses or cushions wherein even torsion throughout the spring or group of springs allows it then to support loads within certain elastic limits generally axially aligned with the coils. This support is generally transferred to the floor or ground through some other additional structure extending horizontally and vertically. The use of relatively planar spring elements to provide both resilience and surface support integral in one element is relatively new and heretofore not well understood. One feature of this invention is that, as will be seen, the support provided can include additional support members extending from, yet integral with, these resilient surfaces to position the surfaces in furniture forms.

There is continuing need for simple, effective, and easily conformable posterior and lumbar support in furniture, such as chairs, sofas, etc. Curvilinearly slotted or contoured panels have been disclosed in the past, but they lacked required versatility, simplicity and ease of fabrication; also, they lacked an understanding of this type of support, sufficient peripheral support structure, and its relationship to the panel design to optimally distribute and transfer loading to furniture members. There is, accordingly, need for an improved spring panel that is easily produced, as by linear slotting, that relates properly to adequate peripheral support, and that provides a serpentine intermediate flat spring structure.

SUMMARY OF THE INVENTION

It is a major object of the invention to provide improved, simple, effective, easily fabricated planar spring panel furniture providing for a peripheral support means, as well as effective flat spring resilient cushioning inwardly of the peripheral support.

As can be appreciated, the thickness of a planar surface relative to its extent and support conditions will determine its strength. It will buckle without significant elasticity when the applied loads exceed certain relative limits. In this invention, elasticity is achieved by increasing the planar thickness above any possibility of buckling, and then forming by any reasonable means the designs described in order to create planar spring elements. In these planar spring elements, support fixity, geometrical constraints, and load characteristics determine the proper shapes. One applicable case is that where both ends of a planar spring element are supported, yet free to rotate, in essence pinned at the support points. Another case is one wherein both ends of the element are restrained from rotating or fixed in position. Two other conditions are a combination of the above and a cantilever.

In the first case, the shear stresses are maximum at the supports and the bending stresses are maximum at the span mid point. This will result in a spring of relatively uniform dimensions. The second case results in both high bending and shear stresses at the support points and relatively smaller stresses in the span center. This will result in a spring of variable dimension, as do the additional cases.

The panels extend longitudinally and laterally or radially and laterally. They have support regions at longitudinal ends integral to the panel which, depending on their extent, are generally fixed for rotation or are allowed to rotate or pinned.

The preferred embodiment of this invention is preferably these items of furniture, although the universality of the principals described herein are applicable to other types of objects.

Basically, the improved panel, for use as in furniture, comprises:

a) the panel extending longitudinally and laterally, and having peripheral edges, b) the panel having a continuous outer support region inwardly of the edges, c) and the panel having an intermediate region bounded by the outer region, d) the intermediate region defining multiple slots extending in generally parallel relation, and multiple slits extending in generally parallel relation to intersect the slots, spacing of the slits relative to width of slits in a range of 2:1 to 12:1, e) the intermediate region defining serpentine load-supporting, flat spring structure.

As will be seen, the slots through the panel typically extend longitudinally; and the slits through the panel extend generally laterally. Also, the slots may be wider than the slits.

It is another object of the invention to provide a support panel which, in its more specific construction, is characterized by:

a) the panel extending longitudinally and laterally, and having bounding structure with peripheral edges, b) there being longitudinally extending, laterally spaced, narrow slots A and C through the panel, the slots extending in generally parallel relation, the slots A and C spaced from the peripheral edges, c) there also being laterally extending, relatively longitudinally spaced narrow slits D and E through the panel, the slits extending in generally parallel relation, d) certain D slits intersecting the A slot and extending toward the C slot, and certain E slits intersecting the C slot and extending toward the A slot.

Such panels may be provided wherein relative longitudinal spacing between the D and E slits is the same, longitudinally of the panel; wherein relative longitudinal spacing between the D and E slits varies, longitudinally of the panel; wherein the A and C slots are wider than the D and E slits; wherein there are terminals defined by successive D and E slits, and the panel has length "l" and width "s" between the terminals where $l > s$; wherein the ratio $l/s$ lies within the range 2:1 to 12:1; wherein the intersections between the A slots and D slits are defined by enlarged openings; and wherein the intersections between the C slots and E slits are defined by enlarged openings.

A further object includes the provision of such a panel with A and C slots, and D and E slits as defined, and wherein there is also a longitudinally extending slot B through the panel, and located laterally between the A and C slots, other D and E slits intersecting the slot B.

Yet another object is to provide a load support panel comprising:

a) the panel extending lengthwise and widthwise, and having peripheral edges, the length either extending longitudinally or radially, b) the panel having an outer support region located at longitudinal spaced intervals extending to the edges, c) and the panel having an intermediate region bounded by the outer region, d) the intermediate region defining multiple slits extending in generally parallel relation, widthwise of the panel, slit width relative to the spacing between adjacent slits being at a ratio of 1:2 to 1:12, e) the intermediate region defining serpentine load-supporting structure, f) and support means supporting the panel at lengthwise spaced locations between which the intermediate region extends.

These and other objects and advantages of the invention, as well as the details of the illustrative embodiments, will be more fully understood from the following specification and drawings, in which:

DRAWING DESCRIPTION

FIGS. 4–7 are plan view of modified planar support spring panels;

FIG. 8 shows a modified panel in plan view;

FIG. 9 is an edge view taken on lines 9—9 of FIG. 8;

FIG. 10 is a view like FIG. 9 but with support couples exerting loading on the panel;

FIG. 11 is a view like FIG. 10 but with central loading also exerted;

FIG. 12 shows another panel similar to the FIG. 8 panel;

FIG. 13 is an edge view of the FIG. 12 panel with a support couple at one end location and a pin connection at the panel opposite end support location;

FIG. 14 is a view like FIG. 13 showing central loading also exerted;

Figure 22:
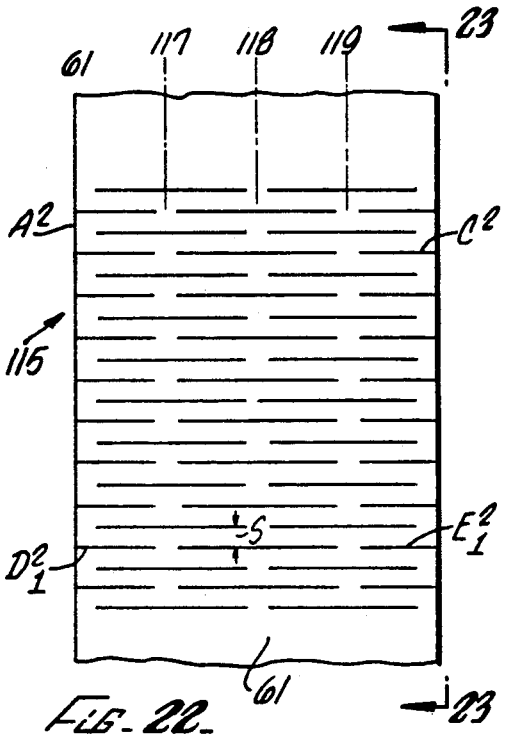
Figure 23:
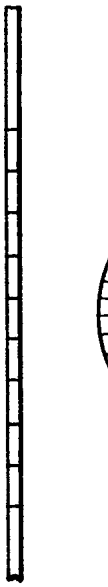
Figure 24:
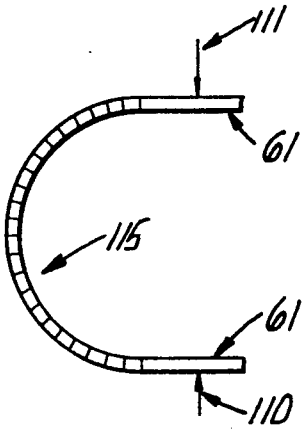
Figure 26:
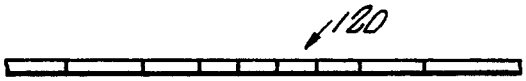
Figure 25:
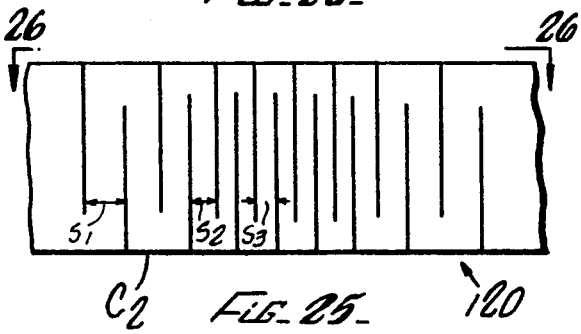
Figure 27:
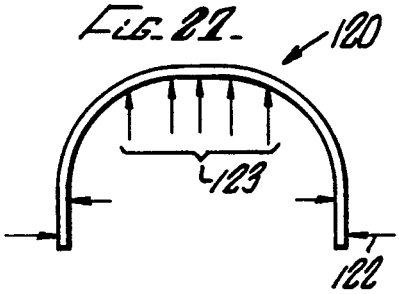
Figure 29:
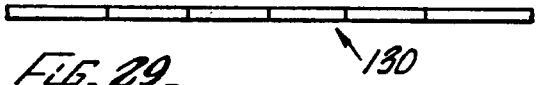
Figure 28:
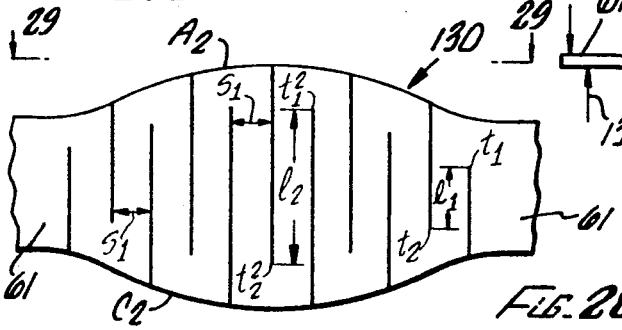
Figure 30:
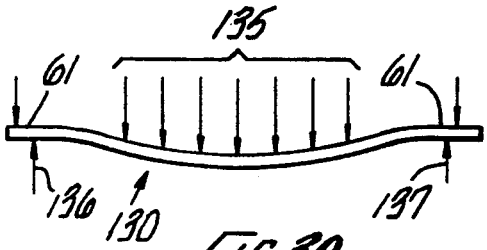
Figure 41:
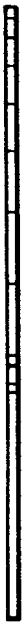
Figure 40:
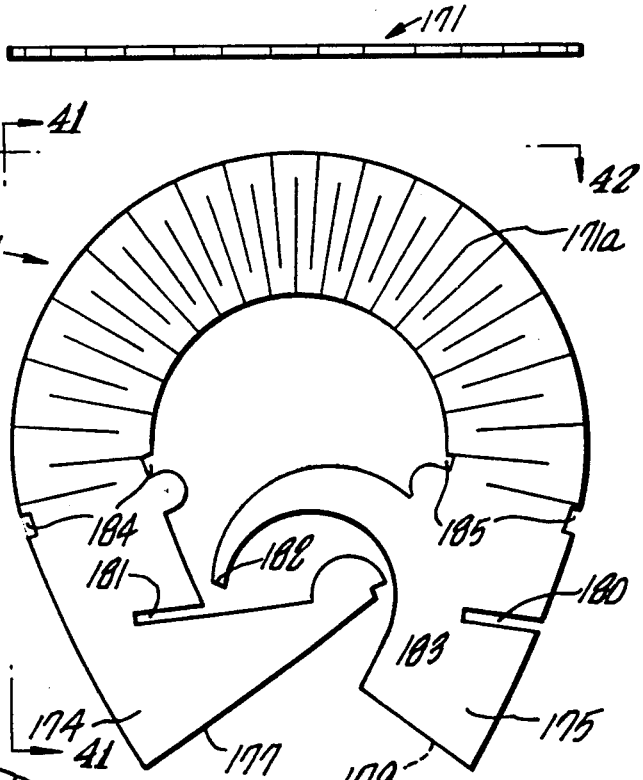
Figure 43:
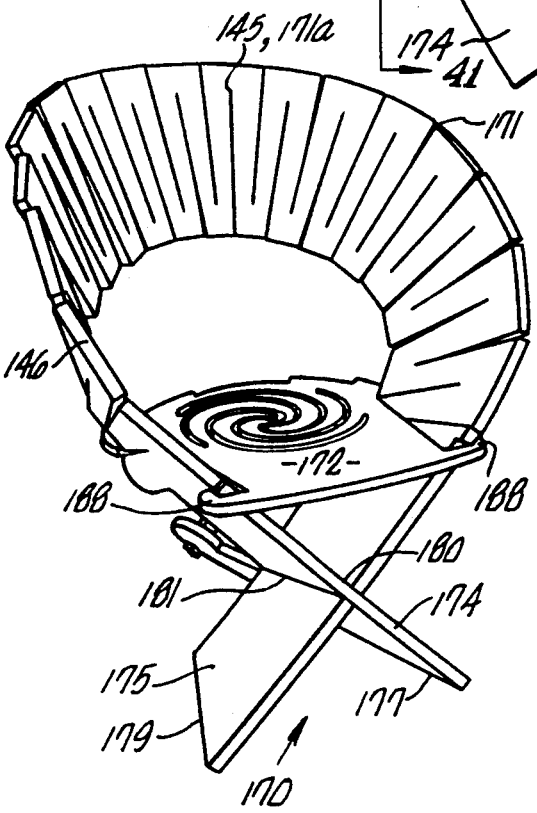
Figure 44:
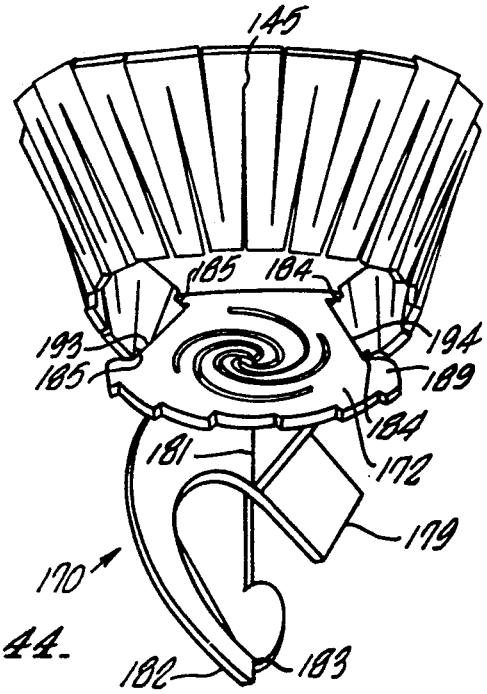
Figures 45, 45B, 45C, 45D:
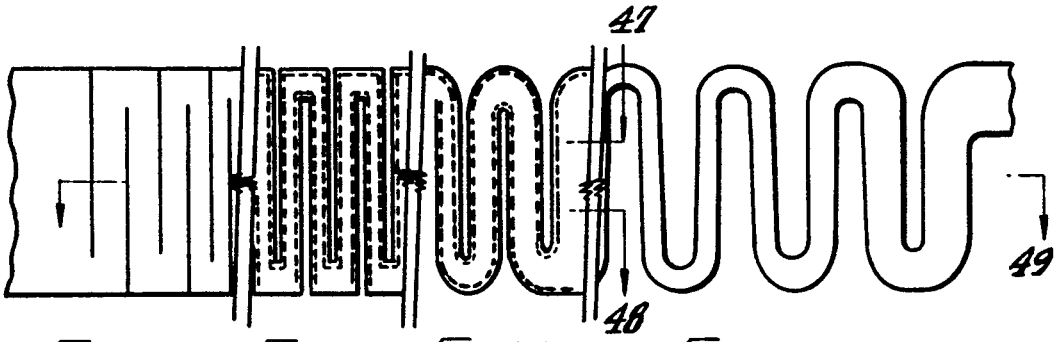
Figure 46A:
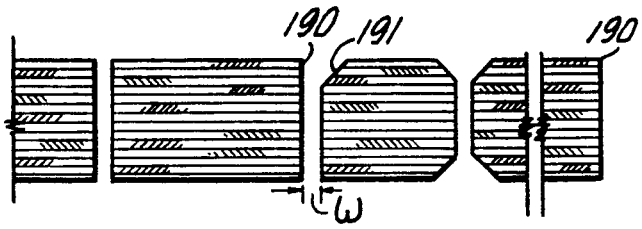
Figure 46B:
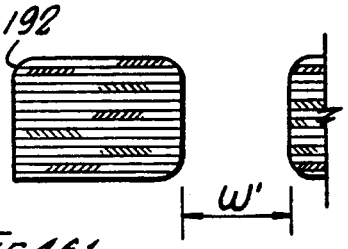
Figure 48:
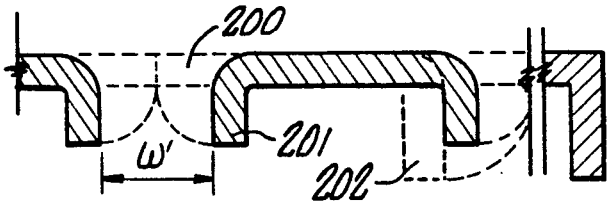
Figure 48:
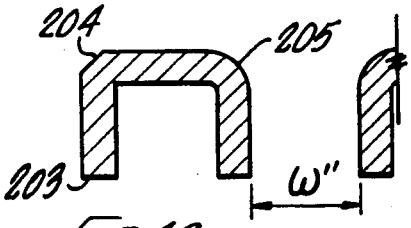
Figure 49:
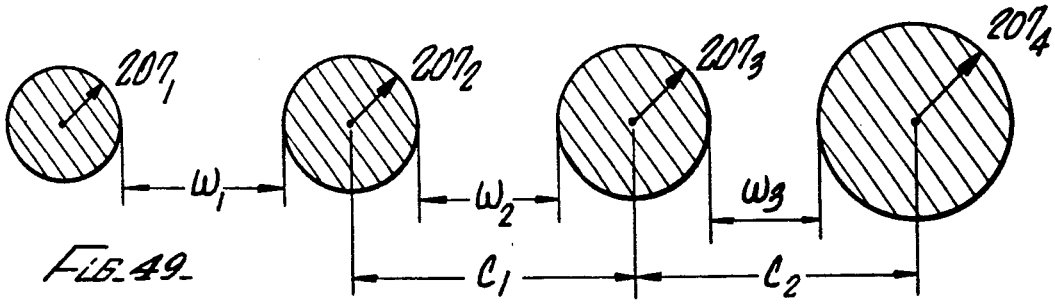
Figure 50:
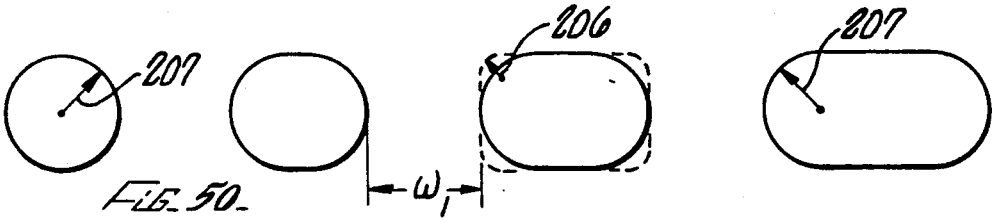
Figure 51:
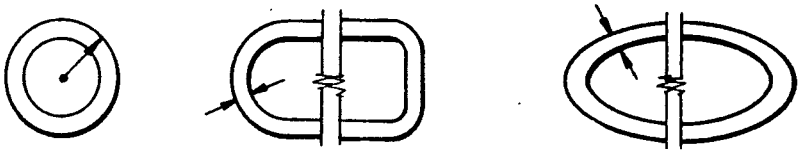
Figure 52:
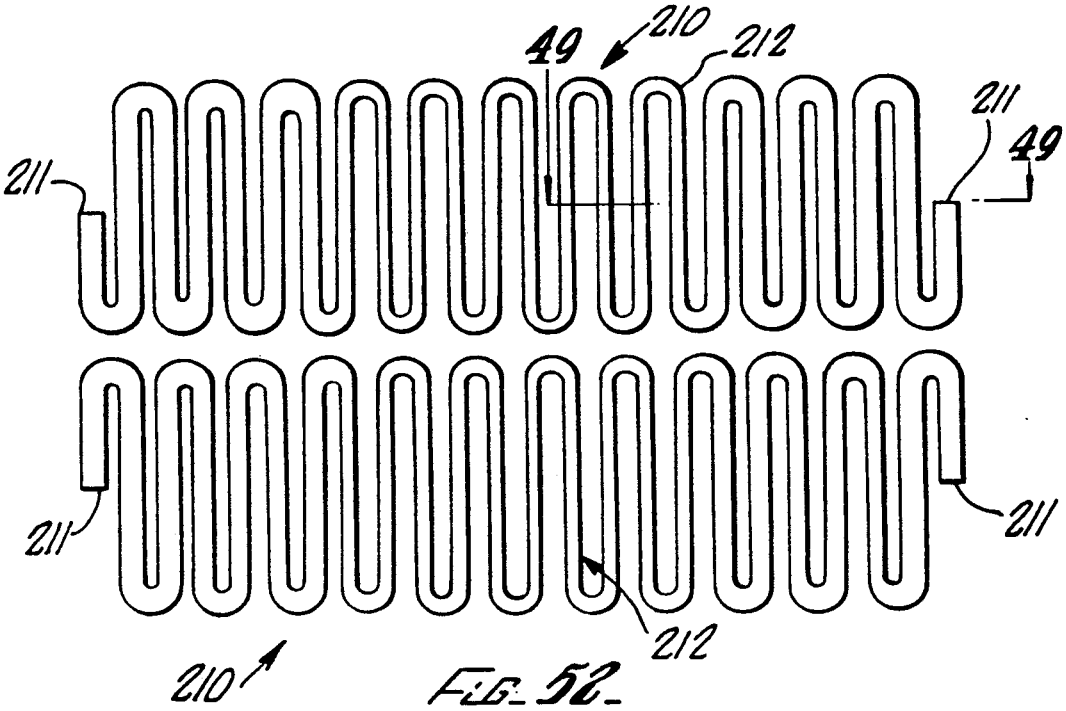
Figure 53:
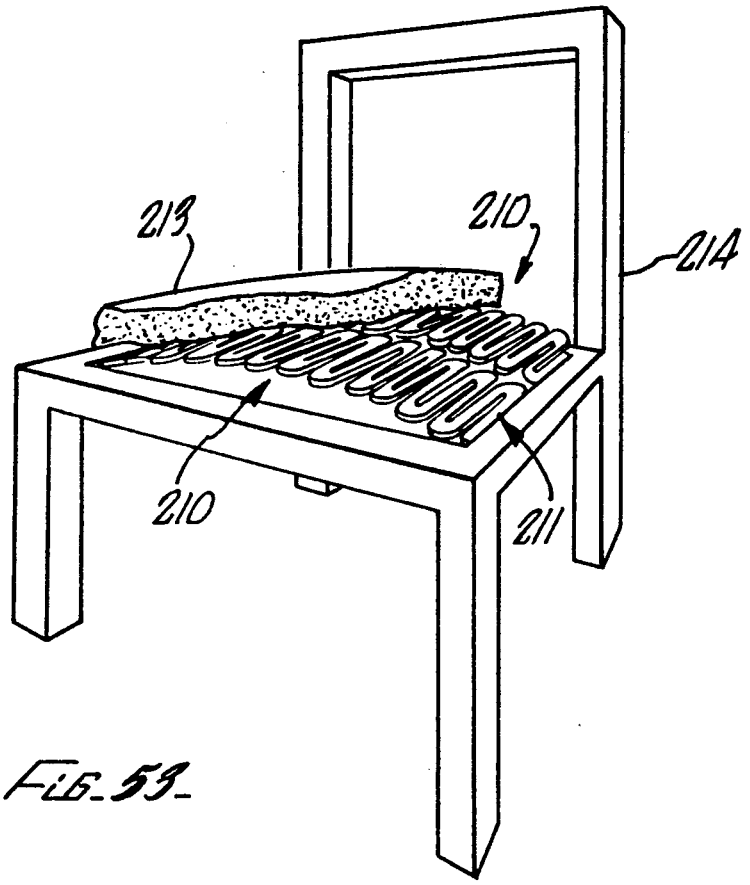

FIGS. 15, 15*a*, 16, and 16*a* show further modified panels in plan view;

FIG. 17 shows a further modified panel in flat configuration;

FIG. 18 is an edge view taken on lines 18—18 of the FIG. 17 panel;

FIG. 19 is a view like FIG. 18 but showing the panel supported with U-shaped configuration;

FIG. 20 is an enlarged view showing the relative positions of relatively rotated panel sections between slits FIG. 19;

FIG. 21 shows the panel sections prior to rotation;

FIG. 22 shows a further modified panel in plan view;

FIG. 23 is an edge view on lines 23—23 of the FIG. 22 panel;

FIG. 24 is a view like FIG. 23 showing the panel supported in U-shaped configuration;

FIG. 25 is a view like FIG. 8 of a modified panel with a relatively more flexible center region;

FIG. 26 is an edge view taken on lines 26—26 of FIG. 25;

FIG. 27 is a view like FIG. 26 showing end support couples, and U-shaped center region loading;

FIG. 28 shows another modified panel in plan view;

FIG. 29 is an edge view of the FIG. 28 panel;

FIG. 30 is a view like FIG. 29 showing end support panels and center region loading;

FIG. 31 shows a radially modified panel with U-shape in a flat plane;

FIG. 31*a* is an edge view on lines 31*a*—31*a* of the FIG. 31 panel;

FIG. 32 shows the FIG. 31 panel deformed into concave shape by end support couples;

FIG. 33 is a plan view of a further modified panel;

FIG. 33*a* is an end view taken on lines 33*a*—33*a* of FIG. 33;

FIG. 34 is a section taken on lines 34—34 of FIG. 33 and after end and center loading is exerted;

FIG. 35 is a plan view of yet another modified panel;

FIG. 35*a* is an end view taken on lines 35*a*—35*a* of FIG. 35;

FIG. 36 shows the FIG. 35 panel after deformation into furniture configuration;

FIG. 37 shows a panel like that of FIG. 33 but notched for chair seat use;

FIG. 38 is an edge view on lines 38—38 of FIG. 37;

FIG. 39 an edge view on lines 39—39 of FIG. 37;

FIG. 40 shows a panel like that of FIG. 31 but with end portions modified to interlock and define chair legs;

FIG. 41 is an edge view on lines 41—41 of FIG. 40;

FIG. 42 is an edge view on lines 42—42 of FIG. 40;

FIG. 43 is a front perspective view of a chair that combines the panels of FIGS. 37 and 40;

FIG. 44 is a rear perspective view like FIG. 43 showing rear detail of modified chair legs;

FIGS. 45*b*, 45*c* and 45*d* are plan views of a panel and modifications thereof;

FIGS. 46*a* and 46*b* are sections showing lamination of such FIG. 45*a* panels;

FIGS. 47 and 48 show enlarged sections taken through the panels of FIGS. 45*b* and 45*c*, as indicated;

FIG. 49 is a section taken through FIG. 45*d*, as indicated;

FIG. 50 is like FIG. 49 showing modified sections;

FIG. 51 is an additional section like those of FIGS. 47 and 48;

FIG. 52 is a pair of panels like that of FIGS. 45*d* and 49 arranged as for use as in a chair seat; and FIG. 53 is a perspective view of a chair in schematic form with spring panels of FIG. 52.

DETAILED DESCRIPTION

Figure 1:
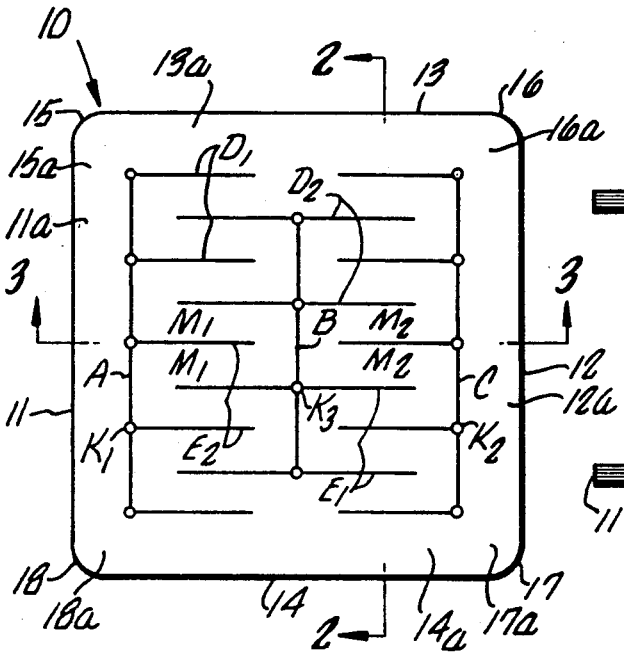
FIG. 1 is a plan view of a planar support spring panel embodying the invention.
Figure 2:
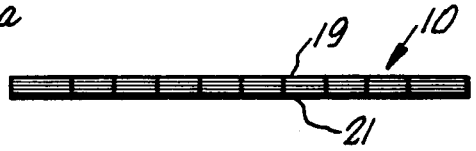
FIG. 2 is a section taken on lines 2—2 of FIG. 1.
Figure 3:
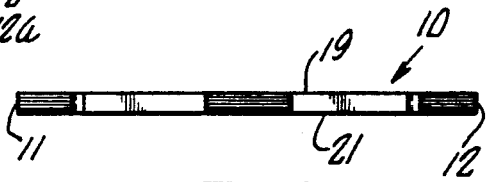
FIG. 3 is a section taken on lines 3—3 of FIG. 1.

Referring first to FIGS. 1–3, the planar, spring-type, load support panel 10 is generally rectangular, as for example square, having peripheral longitudinal edges 11 and 12, and peripheral lateral edges 13 and 14. Arcuate corners appear at 15–18, and the panel has upper and lower flat sides 19 and 21.

The panel 10 has a continuous outer support region to which chair o other furniture structure is connectible. That region extends inwardly of the edges and corners; it is designated by corresponding numerals 11*a*–14*a* and 15*a*–18*a*.

The panel also has an intermediate region bounded by the continuous outer region, the intermediate region located laterally between subregions 11*a* and 12*a*, and longitudinally between subregions 13*a* and 14*a*. The intermediate region defines multiple cuts defined as slots extending generally longitudinally in parallel relation, and multiple cuts defined as slits extending generally laterally in parallel relation to intersect the slots. For example, see longitudinally extending, laterally spaced slots A, B, and C through the panel, and extending generally parallel; and note laterally extending, relatively longitudinally spaced slits D and E through the panel, the latter extending in parallel relation. In particular, the D slits intersecting slot A are $D_1$ slits, and the D slits intersecting slot B are $D_2$ slits; the E slits intersecting slot C are $E_1$ slits, and the E slits intersecting slot B are $E_2$ slits, and wherein slits $E_2$ project laterally in longitudinally alternate and spaced relation to $D_1$ slits, and slits $D_2$ project laterally in longitudinally alternate and spaced relation to $E_1$ slits. Pairs of $D_2$ and $E_2$ slits are co-linear, each pair intersecting the B slot at substantially the same locus. Also, the intersections between the A slot and $D_1$ slits are defined by large, circular openings $K_1$; intersections between the C slot and $E_1$ slits are defined by large, circular openings $K_2$; and intersections between intermediate slot B and slits $D_2$ and $E_2$ are also defined by large, circular openings, $K_3$.

The above construction provides maximum panel support surface area and material for optimum support of the sitter, and structural connection to a chair, while at the same time providing the desired spring effect to cushion the loads imposed by the sitter. Dual serpentine springs are provided, as by the material $M_1$ between $D_1$ and $E_2$ slits, and as by the material $M_2$ between $D_2$ and $E_1$ slits.

Figure 4:
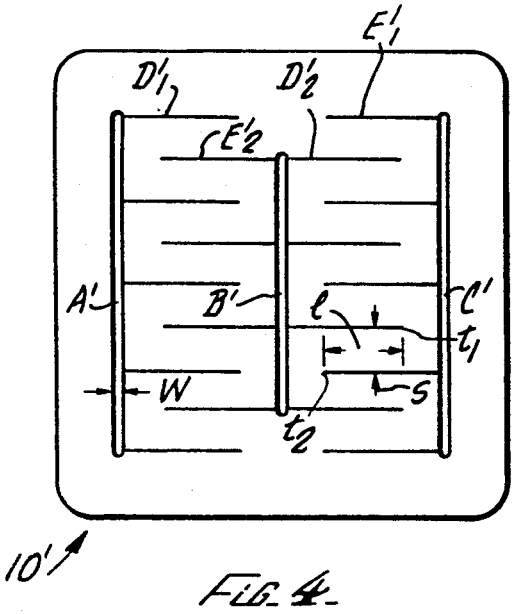

In FIG. 4, the construction of panel 10' is the same as in FIG. 1 except that the slots $A^1$, $B^1$, and $C^1$ corresponding to slots A, B and C in FIG. 1 are widened (see width "w"), eliminating need for the enlarged, circular openings $K_1$, $K_2$ and $K_3$ in FIG. 1.

Figure 5:
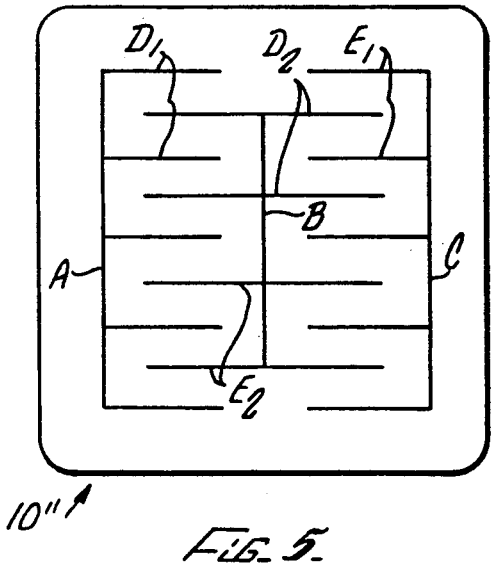

In FIG. 5, the construction of panel 10'' is the same as in FIG. 1 except that the intersections between the slots and slits do not form circular openings. The width of all slots and slits may be the same, i.e., between 1/16 inch and ¾ inch, for example. Note: the width of the slots and/or slits and size of enlarged opening are variably dependent on tooling or appearance conditions.

In FIGS. 6 and 6*a*, the B slot is eliminated; the slits $D^2{}_1$ that intersect slot $A^2$ are of different lengths as shown; and the $E^2{}_1$ slits that intersect slot $C^2$ are also of different lengths. Certain additional intermediate slits, $F_1$, $F_2$, and $F_3$ extend laterally without intersecting $A^2$ or $C^2$. Further, the longitudinal spacing "S" between the $D^2$ and between the $E^2$ and F slits is shown at different spacing longitudinally of the panel in FIG. 6 versus FIG. 6*a*. At the wider spacing "S" in FIG. 6, the $F_1$ slit is longer, and there are no $F_2$ and $F_3$ slits as there are in FIG. 6*a*, where there is a narrower "S".

In FIG. 7, the construction of panel 10'' is like FIG. 5 except that the spacing between $D_2$ and $E_1$ slits, and between $D_1$ and $E_2$ slits decreases in the direction of arrow 41, toward the mid line 42 of the panel; and the spacing between $D_2$ and $E_1$ slits, and between $D_1$ and $E_2$ slits decreases in the direction of arrow 43, toward that mid line. See spacing $S_1 > S_2 > S_3$.

In FIGS. 4 and 7, as in other panels, there are slit terminals $t_1$ and $t_2$ defined between successive D and E slits; and the panel has local lateral length "l" longitudinally between the terminals, and local longitudinal width "s" between the successive slits, where $l > s$. The ratio l/s lies within the range 2:1 to 12:1 for optimum spring and support performance, as assisted by the continuity of the looping outer region of the panel referred to above. The major difference between panels shown in FIGS. 4 and 7 is that, although the lateral distance between A, B and C slots is the same, the l/s ratio varies. In FIG. 4, the l/s ratio appears the same as the $l_1/s_1$ ratio of FIG. 7. However, the $l_3/s_3$ ratio in FIG. 7 is much smaller, reflecting the possibility of relating to the lower stresses away from the support points.

In FIGS. 8 through 14, variations in lateral slit spacing or conversely the l/s ratio are shown in relation to fixity of support conditions with similar loading. The spacing or ratio increases relative to degree of fixity.

In FIGS. 8 and 9, the elements corresponding to those in FIG. 7 are given the same identifying numerals and letters. This is also the case for FIGS. 12 and 13.

In FIG. 10, the support means supporting the panel at lengthwise space locations (between which the intermediate slits-containing region is formed comprise couples generally indicated at 100 and 101. Each couple includes two force application vectors, offset, as shown, producing shear and a moment of force, and resulting in the camber indicated. This condition could be described as having a high degree of fixity, and replaces the continuous outer region of FIGS. 1–7 wherever force vectors or couples are referred to herein, they shall be considered as designating supports for panel support regions.

In FIG. 11, the same couples are shown, together with load application vectors 102 exerting loading over the slits containing intermediate regions, and resulting in the complex curved deformation of the plate as shown. Note that the end portions 13*a* and 14*a* remain in their cambered position and that the lateral slit spacing $S_1$ to $S_3$ increases at these areas. Or conversely, the slit spacing decreases in the direction of arrows 41 and 43 toward the panel center line 42.

In FIGS. 12, 13, and 14, considerations also apply, except that at the right end of the panel, the support force vectors at 104, include a pin end connection (i.e., the panel is attached to structure that holds the panel but does not prevent rotation). The lateral spacing does not increase as significantly toward the pin end connection 104. Note the different positions of $S_2$ at each panel end and the absence of $S_1$ at end 13*a*.

In FIGS. 15 and 15*a*, the construction is generally the same as in FIG. 4 and FIG. 1, corresponding parts bearing the same numerals or letters. However, the spacing between the slits varies lengthwise of the panel, as in FIG. 7. See $S_1$ to $S_3$. The center slot B' is narrowed, as at B, with enlarged circular openings; and the slot C' may be narrowed, as at C, also with enlarged circular openings.

In FIGS. 16 and 16*a*, the slots and slits are shown enlarged and the same width. In FIG. 16, the merger areas $K_1$ of slits $D^1{}_2$ are curved, as shown; and merger areas $K_2$ of slits $E^1{}_1$ and slots C' are curved, as shown. See also curved panel corners at $K_3$. The slits, as at $D^1{}_1$, have width, and the spacing between slits varies. These figures, 15, 15*a*, 16 and 16*a*, show that the variations of slot and slit widths and opening configurations can relate to production process or aesthetic considerations and can be independent of the spacing between the slits or the l/w ratio between slit terminals, as defined in FIG. 4, which vary lengthwise within the panel from support considerations as explained in FIGS. 8–14.

In FIGS. 17 through 21, the construction is similar to FIGS. 8 or 12 except that the width of slits $D_1{}^2$ shown are dependent on degree of angular displacement relative to their lateral spacing. Note that the spacing between the slits $D^2{}_1$ and $E^2{}_1$ lengthwise of the panel 109 is invariant.

In FIG. 19, the opposite ends of the FIG. 17 panel 109 are held parallel and spaced apart, as by forcible support means indicated by vectors 110 and 111. As a result, the panel assumes U-shape, and successive panel sections as at 112 are relatively rotated. A wedge-shaped gap 113, also shown in FIG. 20, is formed between them. The width of slot $D^2{}_1$ is determined so that it is slightly greater than one-half of the wider end of the wedge-shaped slot 113 so that the narrower end does not bind when the panel 15 is deflected. Note that the lack of fixity at panel ends 61 and absence of other applied loads allows for the even longitudinal spacing of the lateral slits.

The panel 115 in FIG. 22 is similar to the panel shown in FIG. 6*a*. The three longitudinal planes 117, 118 and 119 "divide" the panel into sections, each of which is like the panel of FIG. 17. A high strength, multiple spring, multiple slit, integrated panel is provided with enhanced stress distribution capability, and can be deformed into U-shape as seen in FIG. 24, similar to FIG. 19, yet stronger. Better torsional resistance results because of its more effective utilization of the material; the width of each panel section S is closer to the panel thickness.

In FIG. 25, the panel 120 is like the panel seen in FIG. 8, such that the edges $A_2$ and $C_2$ are equidistant and longitudinal spacing of the lateral slits increases toward the supports.

In FIG. 27, panel 120 has been deformed to U-shape, similar to FIGS. 19 and 24, yet held by force couples seen at 121 and 122 similar to FIG. 10. The distributed load vectors 123 in this case are shown applied from inside against the intermediate, more flexible slit areas, although they could just as easily be applied from the outside as in FIG. 11. Again the variable slit spacing is used because of the condition of end fixity and the presence of applied loads.

In FIGS. 28–30, the panel 130 width increases from each lengthwise end of the panel toward the center so that the edges $A_2$ and $C_2$ are curved, and bulge widthwise apart, as shown. The slits $D_1{}^2$ and $E_1{}^2$ are of variable length, but the spacing between them can remain the same. A greater length to width ratio, $l_2/s_1$ vs. $l_1/s_1$, similar to FIGS. 8 and 25, is achieved with the same width $S_1$ between the slits.

In FIG. 30, fixed ends 136 and 137 hold opposite ends 61 in the same plane, as distributed load vectors 135 are applied, as shown to deflect the intermediate slit extent of the panel 130.

In FIG. 31, the panel 140 construction is like that of FIGS. 8 and 25 except that it has U-shape in the same plane. The resultant panel can be deformed in a roughly conical shape, as seen in FIG. 32, and held by force couples 142 and 143 applied to panel opposite ends 61. Such a shape may serve as a chair back 145 with integral arm portions 146.

In FIG. 33, the panel 150 has slits 151 which form spirals about a center 152. The like spiral panel sections 153 between the slits gain in width as $S_1 > S_2 > S_3$ and thus strength outwardly away from that center and are cantilevered.

FIG. 34 shows deflection of the panel 150 at the slits under distributed load indicated by vectors 156. Because the center spring portion of the panel is formed with multiple spiral slits (at least two), a broad, uniform flexing area is achieved. Notice how the center panel portion with width $S_3$ is deflected further than that portion $S_2$ outward of it and again farther than outermost portion $S_1$. Ends 61 of the panel are supported, as indicated by vectors 157.

In FIG. 35, a preferred embodiment of two elongated spring panels, each like that seen in FIG. 17, are merged at 158 and lengthwise slotted at 159 to form a modified panel 160 with lateral slits as shown. The panel 160 is shown sinuous, lengthwise, and has legs 162 attached at narrow webs 161 to mid portions of the panel at lateral sides thereof.

In FIG. 36, the panel 160 is deflected into a cylinder, and the legs 162 are upright forming a footstool. T-shaped retainers 163 and 164 at opposite ends of the panel take the place of the force vectors in prior figures and are adapted to interlock and hold the panel in cylindrical "Ottoman" shape.

The chair 170, seen in FIG. 43, is constituted of two panels 171 and 172, panel 171 being generally like that of FIG. 31, and the other panel 172 being generally like that of FIG. 33. Panel 171, seen in FIG. 40 (similar to FIG. 31), has endwise spaced legs 174 and 175 that interlock and hold the upper slit portion 171*a* of panel 171 in chair shape, with a back 145, and arm sections 146. Edges 177–179 contact the ground, and slots 180 and 181 slide together during the interconnecting of the legs. Also, end 182 fits notch 183 (see FIG. 44). Panel 172, which forms the seat of the chair, has opposite edges which are lengthwise notched at 193 and 194 to fit the curved panel 171, as at notches 184 and 185, as seen in FIG. 43. See end overhangs 188 which fit around the front portions of notches 184 and 185, and rear bumps 189, which fit in the rear portions of notches 184 and 185. Spiral slits 151 are like those in FIG. 33.

FIG. 44 shows a rear perspective view of the chair 170.

FIG. 45*a* shows a panel similar to earlier FIGS. 8 and 17.

FIGS. 45*b* and 45*c* show a similar panel to those of FIG. 16 and 16*a* but with a uniform surface variation of thickness.

FIG. 46*a* is a cross-section through the panel 45*a* if the material is hardwood plywood. Cornerdetails 190 (square) and 191 (beveled) are indicated with slit width "w" shown at about ⅛" if the panel thickness is ¾";

FIG. 46*b* shows the same material cross section with different rounded corner detail 192 and wider slit widths "w".

FIG. 47 is a cross section through FIG. 45*b* and/or 45*c* if the material is a stamped metal. Dotted lines indicate original sheet thickness wherein sheet portions 200 would be bent downward forming flange potions 201 and slot width "w". Of course, the panel could be formed without the flanges 201. Flange 202 shows the different proportions possible if slot is wider or material is thinner.

FIG. 48 is the same cross section if the material is a formed plastic or composite. Flanges 203 can be formed to different depths regardless of slot width "w" and corner details 204 and 205 are indications of the different details possible.

FIG. 49 shows a cross section through FIG. 45*d* wherein the material is indicated as steel although other materials are possible, and the elements are circular in cross section increasing in diameter toward the support, see that radii $207_1 < 207_2 < 207_3 < 207_4$. Note that FIG. 50 shows a similar increase in cross section with a uniformly thick element and radius 207. FIG. 49 additionally shows a variation in "w" wherein $W_1 > W_2 > W_3$, although a uniform "w" is possible. In this case, the "w" varies because the spacing "c" is shown as the same regardless of its location relative to the support. In the above, the "c" dimension refers to center-to-center spacing; the "w" dimension refers to edge to edge.

FIGS. 50 and 51 show solid or hollow plastic or other generally molded material found in cylindrical, oval or tubular sections. Thickness "t" of the hollow sections can vary as material properties change for different embodiments as can the length of radius 206 as it approaches that of the tubular section shown as 207.

FIG. 52 shows a pair of panel elements 210 most likely formed of metals such as steel rod or wire of variable diameters or cross-sections forming a surface area. The cross-section increases toward the support as in section 49 where radii $207_1 < 207_2 < 207_3 < 207_4$. Larger sections 211 are adapted to attached to a fixed support element and center portions 212 resiliently deflect.

FIG. 53 shows a chair frame 214 in which panel elements 210 are supported in the cambered configuration of FIG. 11, similar to a so-called "No-Sag Spring". Cushion 213 is an optional surface covering shown in partial section. Ends 211 are attached to frame element 214 and prevented from rotation.

The above sections 46 through 52 again are shown consisting of stamped or molded plastic, stamped, bent, or cut metals, router or otherwise cut plywood materials, or other material not shown, such as honeycombed sheet materials. They may all be used to form the panels or embodiments as indicated in FIGS. 1 through 44 and 53 which are described as useful to form furniture, but other objects can also be formed.

In the above description, it will be seen that the panel sections have even spacings of slits, or even cross-section elements, where the panel end or ends are pinned allowing rotation; whereas, when the panel ends are fixed, the panel sections have variable spacings or ratios or widths, and the resultant cross sections increase in area as they approach the supports.

Basic to the invention are: a panel member with a pinned end and with even spacing of slits; and, alternately, a panel member with fixed ends, and variable ratios, cross sections or spacing between slits in the member.

I claim:

1. In a planar, spring-type load support panel, for use in furniture or the like, the combination comprising:

a) the panel extending longitudinally and laterally, and having peripheral edges, b) the panel having panel support regions longitudinally inwardly of said longitudinally spaced edges, c) and the panel having a load support region longitudinally intermediate to said panel support regions, d) said intermediate load support region defining multiple slits extending in generally parallel relation, e) said intermediate region defining serpentine load supporting, flat spring structure, f) said slits extending generally laterally, g) the longitudinal spacing between successive laterally extending slits increasing toward said panel support regions.

2. The combination of claim 1 wherein the panel has slots that extend generally longitudinally to intersect said slits.

3. In a planar, spring-type, load support panel, for use as in furniture or the like, the combination comprising:

a) the panel extending longitudinally and laterally, and having bounding structure with peripheral edges, b) there being longitudinally extending, laterally spaced, narrow slots A and C through the panel, the slots extending in generally parallel relation, the slots A and C spaced from said peripheral edges, c) there also being laterally extending, relatively longitudinally spaced narrow slits D and E through the panel, the slits extending in generally parallel relation, d) certain D slits intersecting the A slot and extending toward the C slot, and certain E slits intersecting the C slot and extending toward the A slot, e) said A and C slots and D and E slits bounded by said bounding structure, f) the longitudinal spacing between successive laterally extending slits increasing toward panel opposite ends which are longitudinally spaced.

4. The combination of claim 3 wherein there are terminals defined by successive D and E slits, and the panel has local lateral length "l", and local longitudinal width "s" between the successive slits, wherein the ratio l/s lies within the range 2:1 to 12:1.

5. The combination of claim 3 wherein g) there is also a longitudinally extending slot B through the panel, and located laterally between said A and C slots, other D and E slits intersecting the slot B.

6. The combination of claim 5 wherein the D slits intersecting slot A are $D_1$ slits, and the D slits intersecting slot B are $D_2$ slits, the E slits intersecting slot C are $E_1$ slits, and the E slits intersecting slot B are $E_2$ slits, and wherein h) slits $E_2$ project laterally in longitudinally spaced relation to $D_1$ slits, and slits $D_2$ project laterally in longitudinally spaced relation to $E_1$ slits.

7. The combination of claim 6 wherein pairs of $D_2$ and $E_2$ slits are co-linear, each pair intersecting the B slot at substantially the same locus.

8. In a uniformly thick planar, load support panel, for use as in furniture or the like, the combination comprising:

a) the panel extending lengthwise and widthwise, and having peripheral edges, b) the panel having an outer support region inwardly of at least one of said lengthwise edges, c) and the panel having an intermediate region bounded by said edges, d) said intermediate region defining multiple slits extending in generally parallel relation, widthwise of the panel, alternate slits starting from each side edge and terminating short of the other side edge, e) said intermediate region defining serpentine load supporting, flat spring structure, f) the spacing between successive slits, lengthwise of the panel, increasing toward said outer support region.

9. The combination of claim 8 wherein there is another support region inwardly of another of said lengthwise spaced edges said support regions also comprise one of the following:

i) are structurally fixed for rotation, ii) structurally fixed at one of said regions, and pinned for rotation at the other of said regions, iii) structurally pinned at both of said regions.

10. The combination of claim 9 wherein the panel is lengthwise either straight, radial or a combination such as sinuous.

11. The combination of claim 9 wherein the relative spacing between the slits increases toward the ends that are fixed for rotation.

12. The combination of claim 8 wherein the support means holds the panel in U-shape, lengthwise thereof.

13. The combination of claim 12 wherein successive sections of the panel defined between successive slots are relatively rotated and the slits between such rotated sections have wedge shape crosswise thereof.

14. A uniformly thick panel extending longitudinally and laterally with a surface adapted to become resilient either to support applied loads or to deform or both, such adaptation consisting of laterally oriented and extending slits extending from alternate longitudinal edges terminating short of opposite edges, wherein longitudinal spacing of successive slits decreases away from longitudinally spaced panel support regions.

15. The panel of claim 14 wherein the panel has variable thickness.

16. The panel of claim 15 wherein portions of the panel are curved, stepped, radial or a combination thereof.

17. The panel of claim 14 wherein portions of the panel are curved, stepped, radial or a combination thereof.

* * * * *